United States Patent [19]

Kropiwnicki et al.

[11] Patent Number: 4,549,857

[45] Date of Patent: Oct. 29, 1985

[54] HERMETIC MOTOR COMPRESSOR HAVING A SUCTION INLET AND SEAL

[75] Inventors: Tadek M. Kropiwnicki; Joseph E. Braymer, both of Syracuse, N.Y.

[73] Assignee: Carrier Corporation, Syracuse, N.Y.

[21] Appl. No.: 637,364

[22] Filed: Aug. 3, 1984

[51] Int. Cl.[4] ..... F04B 39/00; F04B 39/10

[52] U.S. Cl. ..... 417/312; 417/415; 417/564; 417/902; 181/403; 62/296

[58] Field of Search ..... 417/312, 313, 363, 373, 417/415, 419, 534, 540, 562, 564, 902, 571; 181/246, 403; 62/296

[56] References Cited

U.S. PATENT DOCUMENTS

| | | | |
|---|---|---|---|
| 2,025,240 | 12/1935 | Higham | 417/571 |
| 2,286,272 | 6/1942 | Higham | 417/419 X |
| 3,398,878 | 8/1968 | Quiram et al. | 417/363 |
| 3,401,873 | 9/1968 | Privon et al. | 417/312 X |
| 3,666,380 | 5/1972 | Ellis | 417/902 X |
| 3,763,659 | 10/1973 | Hover | 62/296 X |
| 3,785,453 | 1/1974 | Buonocore et al. | 417/312 X |
| 3,817,661 | 6/1974 | Ingalls et al. | 417/902 X |
| 3,971,407 | 7/1976 | Hudson et al. | 417/564 X |
| 4,238,172 | 12/1980 | Abe et al. | 417/312 |
| 4,239,461 | 12/1980 | Elson | 417/312 |
| 4,370,104 | 1/1983 | Nelson et al. | 417/312 |
| 4,401,418 | 8/1983 | Fritchman | 417/902 X |
| 4,408,467 | 10/1983 | Murrane et al. | 62/296 |
| 4,411,600 | 10/1983 | Itagaki et al. | 417/312 |

FOREIGN PATENT DOCUMENTS

| | | | |
|---|---|---|---|
| 2426378 | 1/1975 | Fed. Rep. of Germany | 417/562 |
| 14878 | 2/1981 | Japan | 417/571 |
| 471094 | 8/1937 | United Kingdom | 181/403 |

*Primary Examiner*—William L. Freeh
*Assistant Examiner*—Paul F. Neils
*Attorney, Agent, or Firm*—David J. Zobkiw

[57] ABSTRACT

The suction gas supply tubes are made integral with the seal for sealing the gap between the cylinder head and the cylinder block caused by the valve assembly. The suction gas supply tubes have flared inlets and a long, narrow tapering cross section to minimize flow loses. Additionally, the length of the tubes is such that they provide pressure pulse attenuation and tuning.

1 Claim, 6 Drawing Figures

HERMETIC MOTOR COMPRESSOR HAVING A SUCTION INLET AND SEAL

BACKGROUND OF THE INVENTION

As hermetic motor-compressor units have become increasingly more compact, a number of new problems have been introduced which require solutions. Noise generation has become a major problem resulting from the more compact configurations. As expected, discharge noises are increased in the more compact configurations, but suction side noise generation has reached a noise level requiring a solution especially in view of the noise reduction measures taken on the discharge side.

SUMMARY OF THE INVENTION

In a two-cylinder reciprocating hermetic compressor, the suction gas supply to each of the two cylinders is via a pair of long slim suction gas supply tubes running through a space between the stator and the cylinder head and into an enclosure surrounding each valve plate. The long slim tubes are integral with the suction seal so as to effectively utilize the space between the cylinder deck and the stator on one side and the cylinder head on the other side. The tubes extend well above the stator core into the cooler suction gas region. The length of the tubes and their cross sectional area are chosen so that the tubes are tuned to minimize the suction gas pulsations.

It is an object of the invention to provide pressure pulse attenuation and tuning.

It is another object of this invention to provide a suction seal with integral suction gas supply tubes. These objects, and others as will become apparent hereinafter, are accomplished by the present invention.

Basically, the suction gas supply tubes are made integral with the seal located between the cylinder head and the cylinder block. The seal effectively fills and seals the space surrounding the valve plate. The suction gas supply tubes extend well above the stator core into the cooler suction gas region and their length is tuned to minimize suction gas pulsations. If necessary, or desirable, additional pressure pulse attenuation may be obtained by providing a resonant chamber on the side or the top of each tube.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
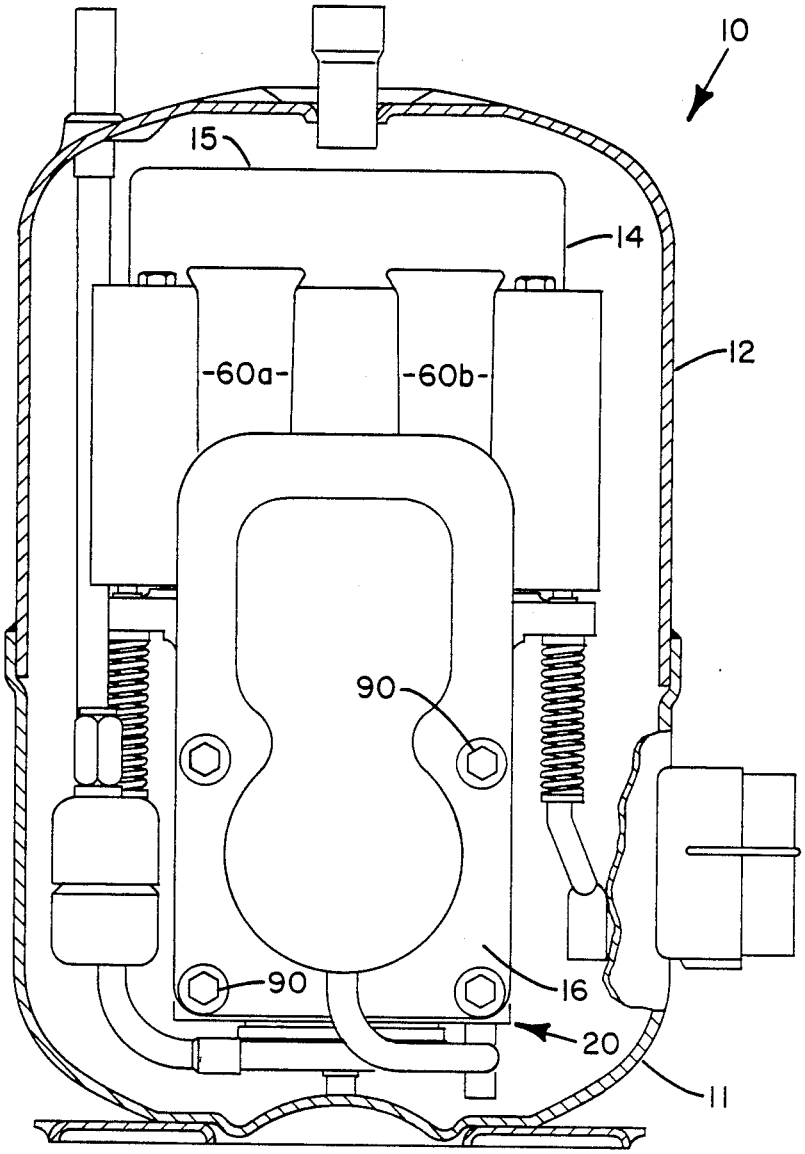
FIG. 1 is a sectioned view of a motor-compressor unit employing the present invention.

In FIG. 1, the numeral 10 generally designates the hermetic motor compressor unit which is in a shell made up of a lower section 11 and an upper section 12 which are welded together. An electric motor 14 and a compressor 16 are disposed within the shell. The compressor 16 is axially aligned with motor 14 and is disposed therebelow.

Figure 2:
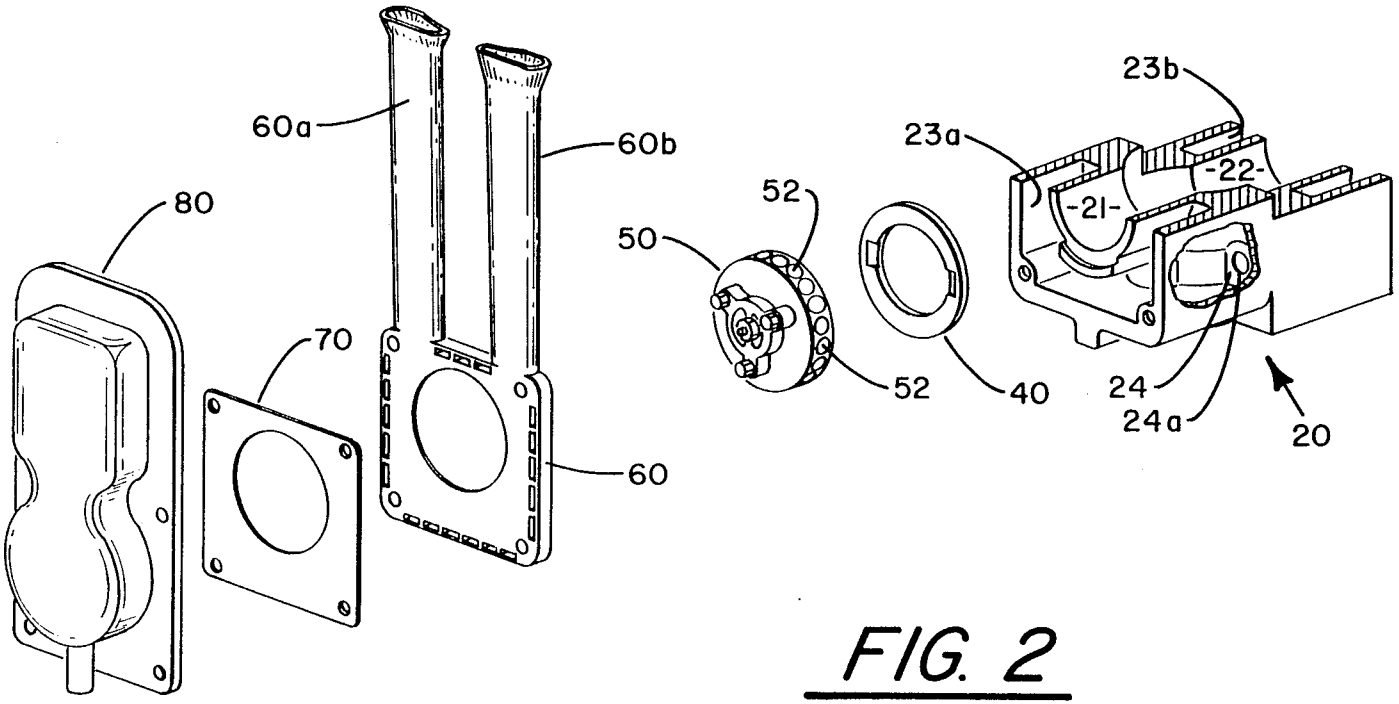
FIG. 2 is an exploded, partially sectioned view of the present invention.
Figure 3:
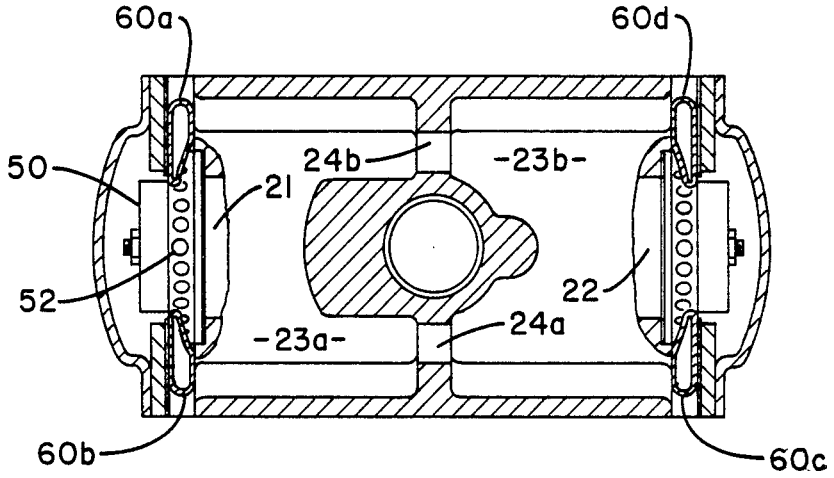
FIG. 3 is a horizontal sectional view showing the fluid paths.
Figure 4:
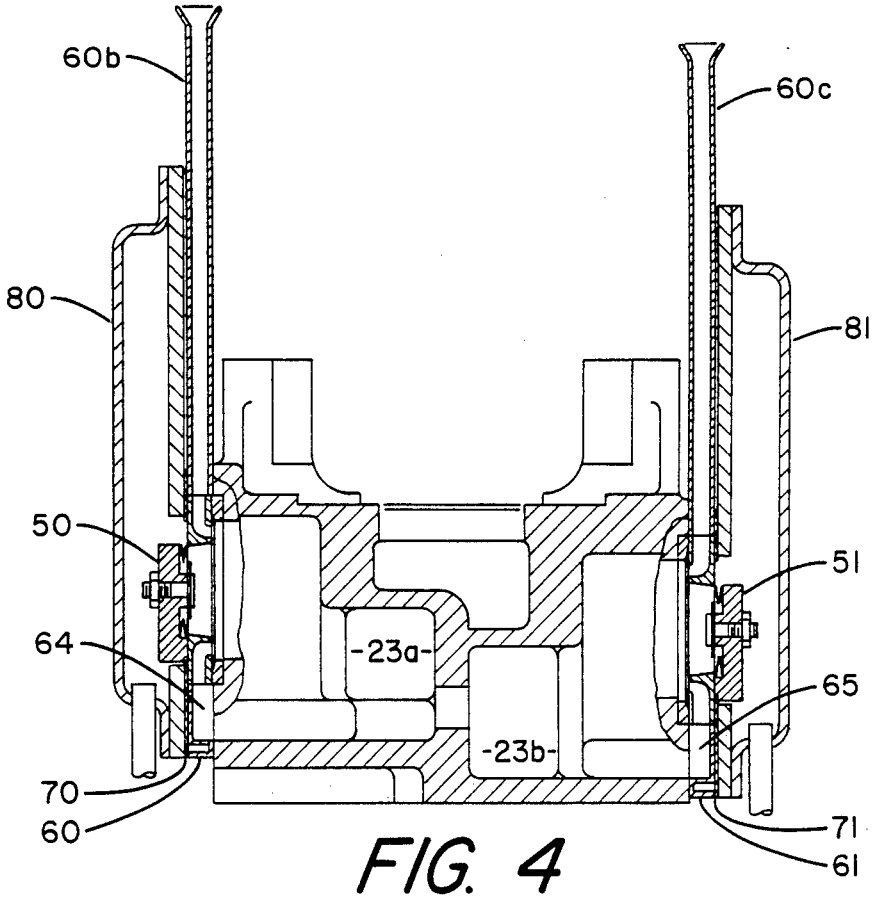
FIG. 4 is a vertical sectional view showing the fluid paths.
Figure 6:
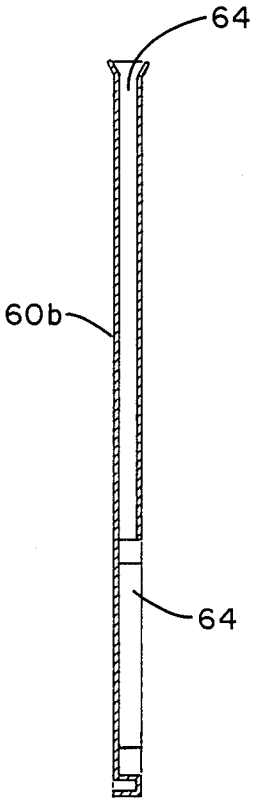
FIG. 6 is a section view taken along line VI—VI of FIG. 5.

The motor 14 includes a stator 15 and a rotor (not illustrated) which is operatively connected to drive the crankshaft (not illustrated) which is supported within the cylinder block 20. Referring now to FIGS. 2–4, the cylinder block 20 receives the suction valve guide 40 which, in turn, receives the valve plate assembly 50. The valve plate assembly 50 is received within the suction inlet and seal 60. Cylinder head 80 is separated from seal 60 by gasket 70. The cylinder block 20, valve guide 40, valve plate assembly 50, seal 60, gasket 70 and cylinder head 80 are bolted together as a unit by bolts 90, as is best shown in FIG. 1.

Referring back to FIG. 2, it will be seen that cylinder block 20 defines two piston chambers 21 and 22 which are surrounded by the suction plenum. The suction plenum is divided into two parts, 23*a* and *b*, by a partition wall 24. The partition wall 24 has two apertures 24*a* and *b* formed therein to provide a restricted fluid communication between the two parts of the suction plenum 23*a* and *b*.

FIGS. 3 and 4 have been taken along several sectional lines in order to show continuity of fluid paths. As best shown in FIG. 3, there are two suction inlets and seals 60 and 61 which define four suction gas supply or inlet tubes 60*a–d* with tubes 60*a* and *b* communicating with plenum 23*a* and tubes 60*c* and *d* communicating with plenum 23*b*. Apertures 24*a* and *b* provide restricted communication between plenums 23*a* and *b*. Suction inlets and seals 60 and 61 are identical and surround valve plate assemblies 50 and 51, respectively, and are separated from cylinder heads 80 and 81 by gaskets 70 and 71, respectively.

Figure 5:
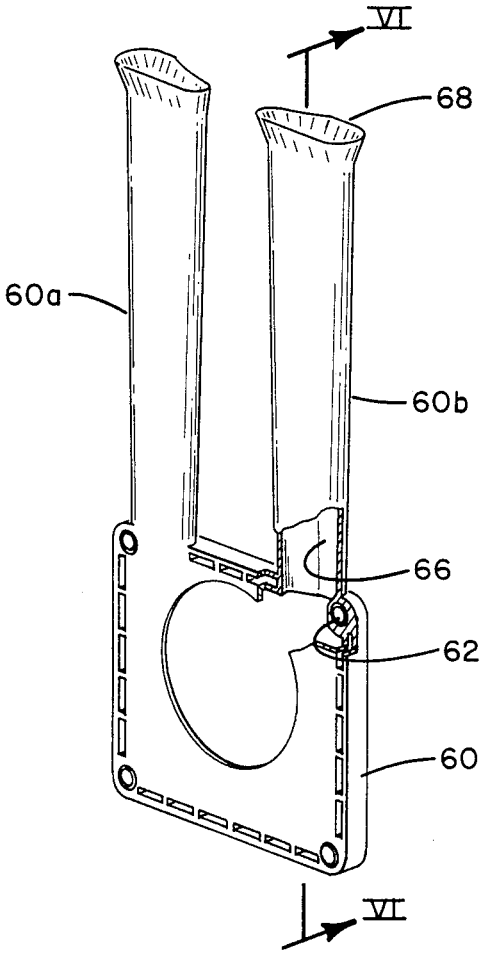
FIG. 5 is an isometric partially cutaway view of the suction inlet and seal.

As best shown in FIGS. 3–6, each of the suction inlets and seals 60 and 61 are identical and tubes 60*a* and *d* are mirror images of tubes 60*b* and *c* respectively. The seals 60 and 61 are molded plastic with tubular steel inserts 62 which minimize creep resulting from clamping forces when seals 60 and 61 are assembled. The plastic chosen should have resistance to creep at high temperatures and resistance to deterioration by refrigerants and oils. A suitable plastic is a 15% glass filled polyester marketed by General Electric Company under the name Valox DR-51. Also, the low thermal conductivity of the plastic minimizes suction gas super heating. Referring specifically to tube 60*b* as typical, the inlet 68 is flared and of a long, narrow tapering cross section as best shown in FIG. 3. The flare and the long, narrow tapering cross section minimizes flow losses. Referring now to FIG. 5, the passageway defined by each tube terminates in a throat to increase the gas velocity so as to improve gas distribution into the chamber. Specifically, tube 60*b* has a throat 66 which discharges gas into chamber 64 surrounding valve assembly 50. The throat 66 is restricted at the entrance to chamber 64 by the plastic material surrounding the adjacent tubular steel insert 62. Additionally, the length of tubes 60*a–d* is such that in combination with the cross sectional area, it provides pressure pulse attenuation and tuning as well as drawing gases from the cooler sections of the motor-compressor unit 10. Further, since the valve plate assemblies 50 and 51 extend out past the cylinder block 20, the seals 60 and 61 serve to seal the gaps between the cylinder block 20 and cylinder heads 80 and 81 and permits the use of inexpensive cylinder head construction such as low cost stamped steel or aluminum die casting. Each one of the tubes 60*a–d* is in fluid communication with each one of the piston chambers 21 and 22 when the corresponding pistons are on the suction stroke. More specifically, tubes 60*a* and *b* discharge into suction plenum 23*a* while tubes 60*c* and *d* discharge into suction plenum 23*b*. Since suction plenums 23*a* and *b* are in fluid communication via apertures 24*a* and *b* in partition 24, there is a continuous fluid path between tubes 60*a–d* and both suction plenums 23*a* and *b*. Flow is unidirectional toward the suction plenum that is associated with a piston in the suction stroke.

Assuming that the piston associated with piston chamber 21 is on the suction stoke while the piston associated with piston chamber 22 is on the discharge stroke, a suction pressure will be established in suction plenum 23*a*. Refrigerant in the shell of the hermetic motor compressor unit 10 will then be drawn into tubes 60*a* and *b* and pass into the rectangular space 64 surrounding valve plate assembly. Rectangular space 64 is in direct fluid communication with suction plenum 23*a*. Refrigerant is drawn into piston chamber 21 from space 64 and plenum 23*a* via inlet openings 52. Because suction plenum 23*a* is at a vacuum relative to suction plenum 23*b*, additional refrigerant is drawn into plenum 23*a* from plenum 23*b* via apertures 24*a* and *b*. This, in turn, creates a vacuum in plenum 23*b* relative to the interior of the shell of hermetic compressor unit 10 causing refrigerant to be drawn into tubes 60*c* and *d*, through rectangular space 65 and into plenum 23*b*. Since the flow paths from tubes 60*a* and *b* to piston chamber 21 are much shorter than the flow paths from tubes 60*c* and *d* to piston chamber 21, as well as being unrestricted by apertures 24*a* and *b*, and, because of the short stroke duration, flow through tubes 60*a* and *b* is much greater than the flow through tubes 60*c* and *d*. However, there is flow through each of the tubes 60*a–d* so that there is no stoppage of flow and the resultant noise. The analogous situation exists when the piston associated with piston chamber 22 is in the suction stroke and the flow is much greater through tubes 60*c* and *d* than tubes 60*a* and *b*.

From the foregoing it is readily apparent that the present invention provides an integral seal and suction gas supply tube construction which provides pressure pulse attenuation and timing for the design speed and supplies suction gas to the chamber surrounding the associated valve assembly as well as to the associated suction plenum. Additionally, a seal is provided which spans and seals the gap between the cylinder block and the cylinder head.

Although a preferred embodiment of the present invention has been illustrated and described, other changes will occur to those skilled in the art. For example, resonant chambers can be formed as part of the suction tubes for greater noise attenuation.

What is claimed is:

1. In a hermetic compressor assembly including a shell containing a compressor having a cylinder block, a cylinder head, a pumping chamber formed by a cylinder in the cylinder block, a pumping member in the form of a piston, suction and discharge valves and an electric motor, the improvement comprising a member defining both a suction inlet and a seal comprising:

a housing means located between the cylinder head and the cylinder block and defining an opening for receiving the suction valve in a radially spaced relationship with said opening so as to define therewith a space to permit fluid communication to the suction valve; and a plurality of suction gas supply means in the shell for delivering gaseous refrigerant from within the shell to said space defined by said radially spaced relationship for delivery to the suction valve with each of said plurality of suction gas supply means including a long narrow tube having a flared inlet and a turned length and terminating in a throat to increase gas velocity into the space defined by said radially spaced relationship.

* * * * *